US006776666B1

(12) United States Patent
Kan

(10) Patent No.: US 6,776,666 B1
(45) Date of Patent: Aug. 17, 2004

(54) ELECTRICAL CONNECTOR ASSEMBLY

(76) Inventor: Chin-Mao Kan, No. 20, Ln. 211, Pu Chung Rd., Chung Li, TaoYuan (TW)

( * ) Notice: Subject to any disclaimer, the term of this patent is extended or adjusted under 35 U.S.C. 154(b) by 0 days.

(21) Appl. No.: 10/353,049

(22) Filed: Jan. 29, 2003

(51) Int. Cl.[7] ..... H01R 24/00
(52) U.S. Cl. ..... 439/676; 439/638
(58) Field of Search ..... 439/676, 490, 439/638

(56) References Cited

U.S. PATENT DOCUMENTS 4,806,117 A * 2/1989 Johnston ..... 439/344
4,904,209 A * 2/1990 Nelson ..... 439/676
6,358,093 B1 * 3/2002 Phommachanh et al. ... 439/620
6,579,127 B2 * 6/2003 Hess et al. ..... 439/676
2002/0151224 A1 * 10/2002 Liao ..... 439/676

* cited by examiner

*Primary Examiner*—Michael C. Zarroli
(74) *Attorney, Agent, or Firm*—Troxell Law Office PLLC

(57) ABSTRACT

An electrical connector assembly including a plurality of circuit terminal sets, each having an input end respectively connected to an external device for receiving electric signals, which are then output to another application device through an output end; and a structure part that includes a plurality of fixing units. Each circuit terminal set corresponds to a fixing unit that is used as a fixing support and is made of a harder material, such as plastic. The fixing unit further includes a plurality of grooves, each of which is used as electrical separation and protection for the terminal; and a connecting unit that has flexibility to connect and fix the plural fixing units.

5 Claims, 4 Drawing Sheets

ELECTRICAL CONNECTOR ASSEMBLY

FIELD OF THE INVENTION

The invention relates to an improved structure of connector, especially to an improved structure that applies its connection unit to be able to increase yield and reduce cost.

BACKGROUND OF THE INVENTION

It is quite often seen that connector is used in electric circuit, especially in the jointing point of signal exchange or the jointing place of element. For example, the connecting head of telephone line or internet line on the internet card is a media for transferring outside electric signal into internet card. The major function of a connector is to act as a connecting media, but it is also necessary to consider the fixing problem because, as long as the contact is poor, it is easy to cause signal error, even to cause the signal to be unable to be received completely, so a stable support is helpful to the stability of signal.

Please refer to FIG. 1, wherein a traditional connector that is quite often seen in current market includes two circuit terminal sets 11, 12, and a structure part 2. Two circuit terminal sets 11, 12 respectively connect to two external devices. In this embodiment, the input end 110 of a circuit terminal is not only connected to the circuit plate to make electric connection with the device, circuit, and element thereof, but also has a function of firm fixation. The input end 120 of another circuit terminal set 12 may be connected to another device 22, such as integrated circuit, element, etc. for achieving electric connection. The output ends 111, 121 of two circuit terminal sets 11, 12 are commonly connected to another application end 23. If they are connected to IC circuit, element, etc., then it is possible to connect two output ends 111, 121 directly together. The structure part 13 is composed of harder material, such as plastic for the purposes of fixation and support. In order to avoid the short circuit caused by the close distance between each terminal or the damage phenomenon caused by the touch of other device, the structure part 13 further includes plural grooves 131 to act as electric separation and protection. Furthermore, in order to make two terminal sets 11, 12 be able to commonly open to same direction for the convenience of following usage, the structure part 2 further includes plural opens 132 to allow the terminal to be bent and pass through.

Please refer to FIG. 2, which is a manufacturing flowchart for traditional connector.

Step 31 Cutting copper piece into needle shape: manufacturing such connector 1 and depending on actual need, the copper piece is cut into needle shape according to the number required by the terminal, because conductive media is usually made of copper.

Step 32 Bending: the needle-shaped copper piece is bent into needed form, such as the "ㄣ" form shown in FIG. 1.

Step 33 Plastic injection: the formed copper piece is processed with "plastic injection" through mold; the purpose of this action is to adhere plastic onto copper piece, such that the formed structure part 13 is used as fixation and protection.

Step 34 Post-process: cut off the unnecessary part and make last inspection.

For example, to manufacture the "ㄣ" (staircase)-formed connector shown in FIG. 1, the needle-shaped copper piece must be bent from plane shape into "ㄣ" shape. During the action of plastic injection, since the copper piece has already been bent into "ㄣ" shape, so plural molds are needed for processing multiple actions of plastic injection. Step by step and as shown in the figure, the plastic is then adhered onto the copper piece formed as "ㄣ" shape. Finally, the parts used as fixation and support are removed in the process. Such complicated process and especially for "plastic injection", plural molds are needed for multiple actions. Not only does it take time, but also is the yield influenced because of more steps, such that the cost is increased. In addition, the bent copper piece and the connector occupy too much space and the bending angle can not be changed after the action of plastic injection. Accordingly, all these are adverse factors in this time of global competition. In order to enhance the competition of product, the inventor has finally developed an innovative connecting device to solve above-mentioned problems after mind-devoted research, many tests and experiments.

SUMMARY OF THE INVENTION

The main objective of the present invention is to provide an improved structure of connector, which may electrically connect two devices and reduce the usage of mold, such that the yield and the competition are enhanced.

The secondary objective of the present invention is to provide an innovative connector's improved structure, such that the connecting device may ground.

Another objective of the present invention is to provide an improved structure of connector, such that the connecting device may be adjusted to an appropriate curvature.

To achieve above-mentioned objectives, the invention provides a connector's improved structure, which includes:

Plural circuit terminal sets, of each which the input end respectively connects to external device for receiving electric signals, which are then output to another application device through output end; and A structure part, which further includes:

Plural fixing units; each circuit terminal set is corresponded to a fixing unit that is used as fixing support and is comprised of harder material, such as plastic; the fixing unit further includes plural grooves, each which is used as electrical separation and protection for the terminal; and A connecting unit, which has flexibility to be able to connect and fix the plural fixing units.

DETAILED DESCRIPTION OF THE INVENTION

For your esteemed member of reviewing committee to further recognize and understand the characteristics, objectives, and functions of the present invention, a detailed description together with corresponding drawings are presented thereinafter.

Figure 3:
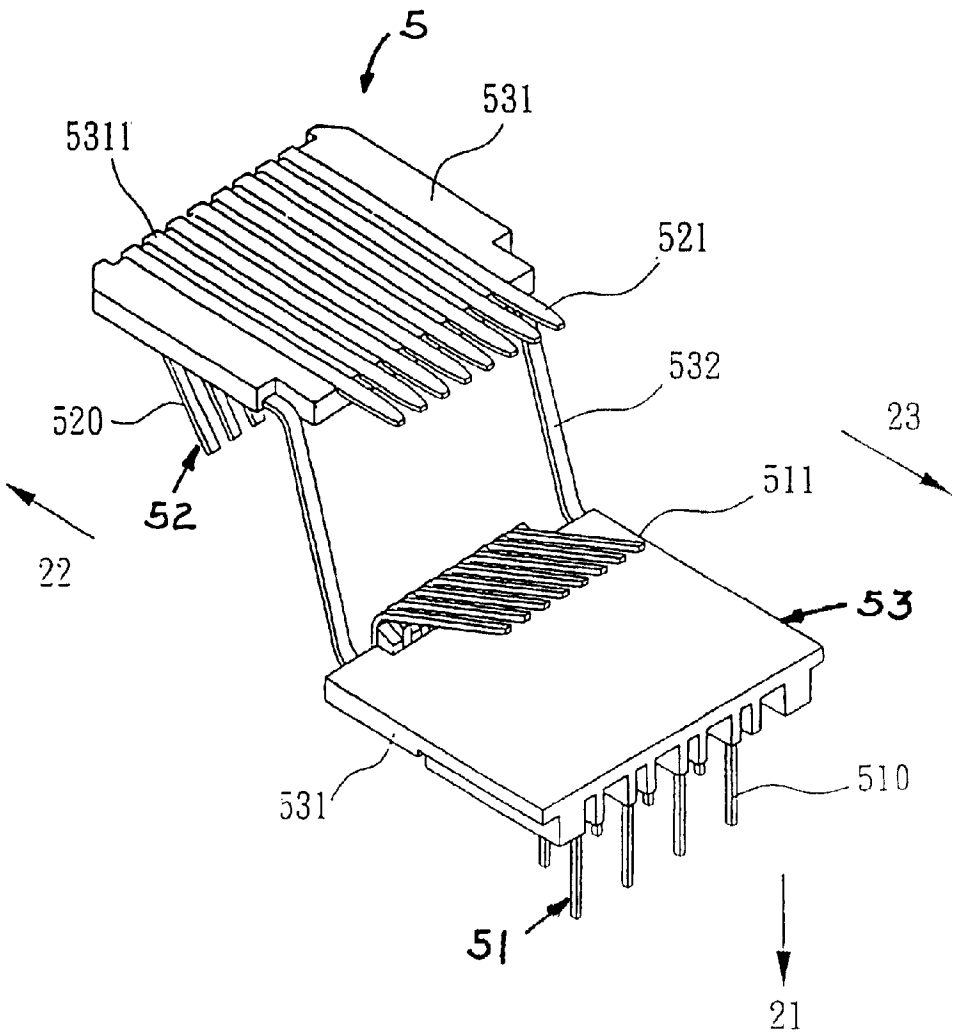
FIG. 3 is a 3-D illustration for a preferable embodiment according to the present invention.

Please refer to FIG. 3, which is a 3-D embodiment according to the invention. The structure of this embodiment of improved connector 5 is similar to that of the traditional connector 1; i.e., it also includes two circuit terminal sets 51, 52, and a structure part 53. The two circuit terminal input ends 510, 520 are respectively connected to two external devices 21, 22, such as device, circuit, and element, etc., while the output ends 511, 521 of the two circuit terminal sets 51, 52 is commonly opened and connected to other application end 23, of which the application field is very wide; i.e., it may be two sets of terminals directly connected to each other, or be connected to other device, circuit, and element, etc. The structure part 53 further includes plural fixing units 531 and a connecting unit 532. The fixing unit 531 is composed of harder material such as plastic to act as the fixation and support for the circuit terminal. The fixing unit 531 also includes plural grooves 5311 to be acted as the electric separation and protection for the terminal. The groove 5311 may be exposed, or be covered within the plastic for enhancing its effects of protection and electric insulation. The connecting unit 532 is composed of copper piece and is connected to plural connecting units 531. Except the functions of fixation and connection, it also has the flexible function of slight adjustment according to the real situation.

Figure 4:
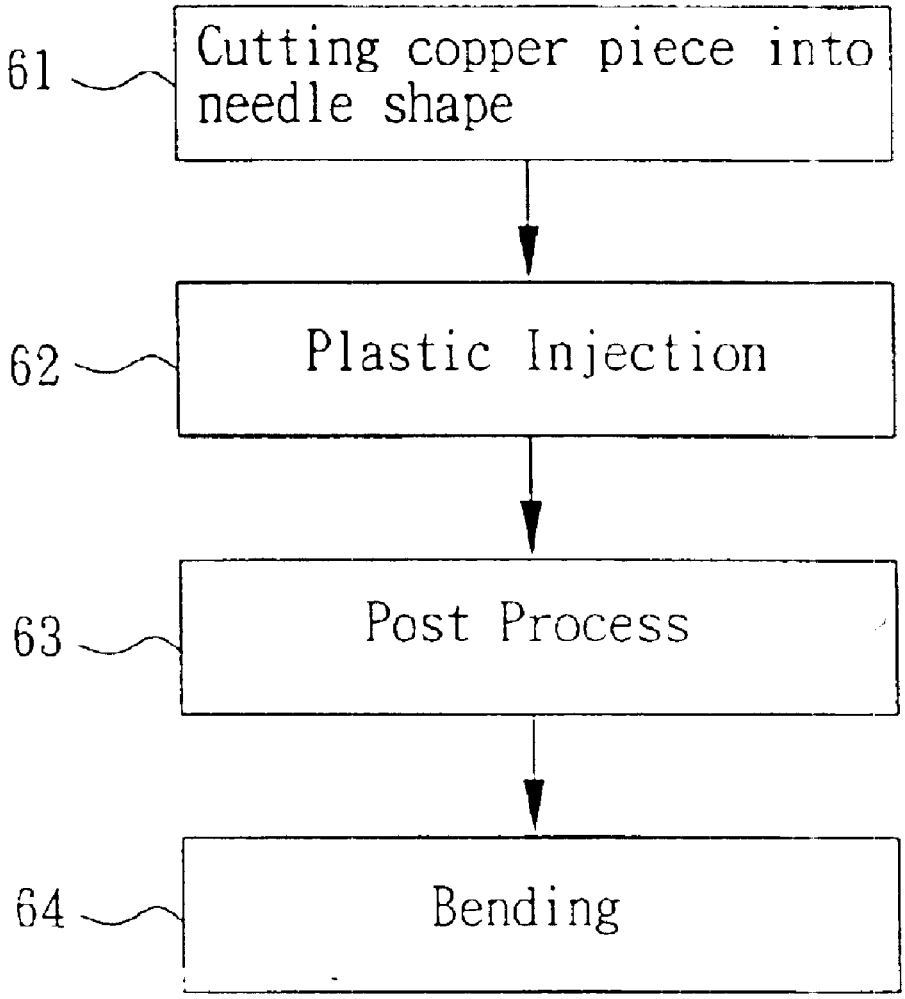
FIG. 4 is a manufacturing flowchart for the connector according to the present invention.

Please refer to FIG. 4, which is a manufacturing flowchart of the connector according to the present invention.

Figure 1:
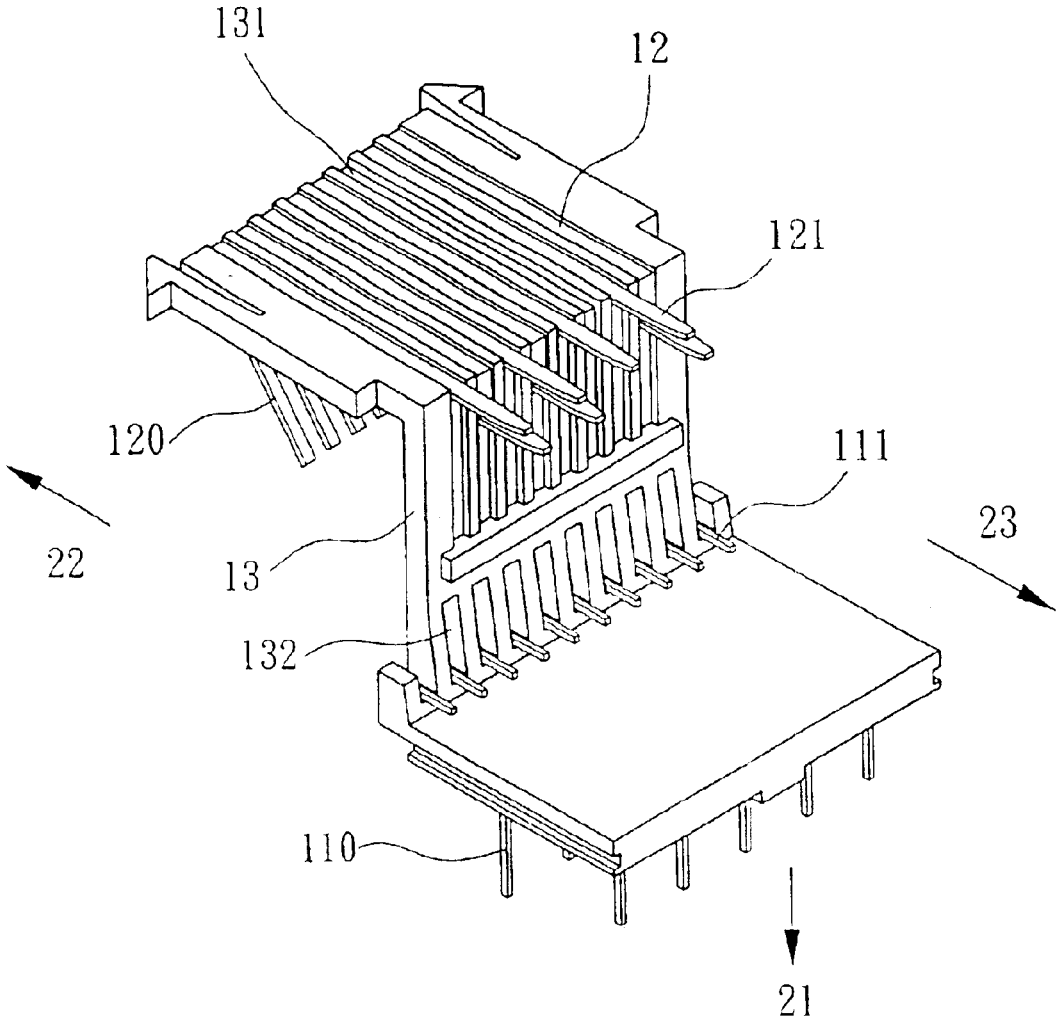
FIG. 1 (PRIOR ART)
FIG. 1 is a prior connector that is often seen in current market.
Figure 2:
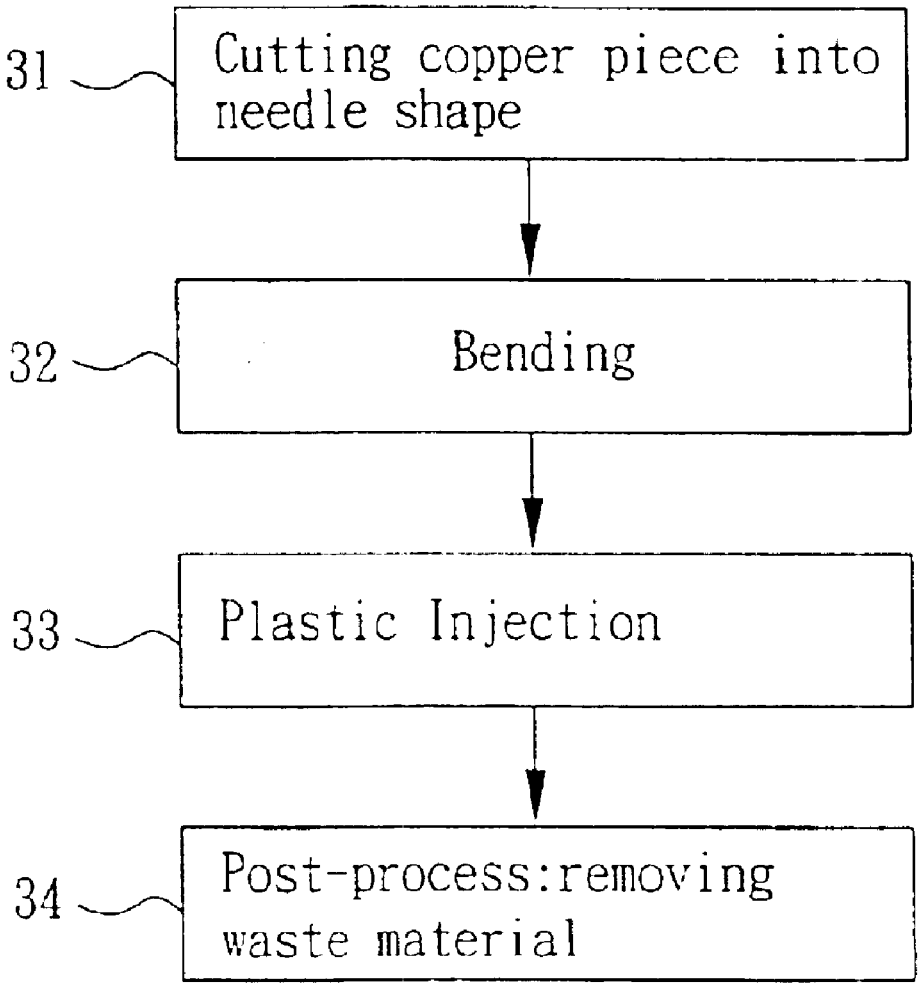
FIG. 2 (PRIOR ART)
FIG. 2 is a manufacturing flowchart for traditional connector.

Step 61 Cutting copper piece into needle shape: similar to FIG. 2, it all starts from cutting copper piece into needle shape; the copper piece will be cut into needle shape in cooperation with the required number of terminal.

Step 62 Plastic injection: in this manufacturing step, the invention will execute the step of plastic injection; at this time, the copper piece is still under the plane state, so it is unnecessary to accomplish the plastic injection through multiple phases, and only one mold and one step are needed to finish the work.

Step 63 Post process: cut off the unneeded parts and fix the edges.

Step 64 Bending: at last, the connector is bent according to the needed formation and is fixed into the groove 5311.

Since the bending is processed at the last step according to above flowchart, so the copper piece still remains as a plane state during the step of plastic injection. Therefore, only one mold and one step are needed to adhere the plastic onto the predetermined place. And, it is unlike the manufacturing process of tradition to repetitionally execute the step from one section to other section, so the speed of manufacturer is increased, and it is helpful to the yield because of the reduction of step. Since the copper piece is under a plane state during the manufacturing process, so it may reduce the working space and facilitate machine to work.

Such improved structure has other advantages: since each device connected externally with the connector can not one hundred percent fulfill the specification, so it is impossible for the traditional connector 1 to do any further adjustment according to the real situation because it has already been fixed, while the connecting unit 532 of this improved connector 5 may be slightly adjusted according to actual situation, such that the adaptability of the invention is further enhanced. Furthermore, the traditional connector 1 is the edge part of the cut-off copper piece, which is made as a connecting unit 532 in this improved connector 5, such that the waste of the original material may be utilized, no other additional material is needed, and the cost of the plastic material may be further saved. Thirdly, it is sometimes uneasy to reach the grounding place because the size of current electronic element is made as smaller as possible and, since the connecting unit 532 of the invention is made of electrically conductive material, so the connecting unit 532 may be acted as grounding point for each element when it is necessary Fourthly, the connecting unit 532 is composed of two copper pieces, so there is sufficient space for the circuit terminal to bend and pass through while, in the traditional connector 1, additional open 132 is needed to allow the circuit terminal to pass through. Therefore, according to the present invention, the complication of manufacture will be relatively reduced, such that it will be helpful positively to the yield, manufacture speed, and mold cost, etc.

However, above description is only the preferable embodiment of the present invention and can not be regarded as a restriction for its scope. That is, any variation and modification made according to the claimed field of the invention still possess its merits and are also within its spirit and field, so they are all regarded as further executing situations for the present invention.

What is claimed is:

1. An electrical connector assembly comprising:

a) a plurality of circuit terminal sets, each of the plurality of circuit terminal sets has an input end connected to a first external device for receiving electric signals that are output to another application device through an output end; and b) a structure part having:

i) a plurality of fixing units; each circuit terminal set corresponds to a fixing unit that is used as a fixing support, each fixing unit includes a plurality of grooves, each of which is used as electrical separation and protection for one of the plurality of terminal sets; and ii) a flexible connecting unit connecting the plurality of fixing units, wherein the flexible connecting unit has a shape that is micro-adjustable according to an actual situation.

2. The electrical connector assembly according to claim 1, wherein the circuit terminal set may be composed of electrically conductive materials.

3. The electrical connector assembly according to claim 1, wherein the fixing unit may be comprised of plastic.

4. The electrical connector assembly according to claim 1, wherein the connecting unit is comprised of the redundant material of the circuit terminal set.

5. The electrical connector assembly according to claim 1, wherein the connecting unit is used as a grounding point.

* * * * *